US007156350B1

(12) United States Patent
Velasquez

(10) Patent No.: US 7,156,350 B1
(45) Date of Patent: Jan. 2, 2007

(54) TRASH BAG CARRIER

(76) Inventor: Raymond L. Velasquez, 805 W. Wheat, Ulysses, KS (US) 67880

( * ) Notice: Subject to any disclaimer, the term of this patent is extended or adjusted under 35 U.S.C. 154(b) by 100 days.

(21) Appl. No.: 11/035,006

(22) Filed: Jan. 13, 2005

(51) Int. Cl.
*A63B 55/04* (2006.01)

(52) U.S. Cl. ..... 248/97; 248/153; 248/175; 141/390

(58) Field of Classification Search ..... 248/97, 248/99, 95, 153, 175; 193/25, 25 R, 25 C, 193/25 FT, 17; 141/390, 314
See application file for complete search history.

(56) References Cited

U.S. PATENT DOCUMENTS

| | | | | |
|---|---|---|---|---|
| 3,638,888 | A * | 2/1972 | Ross | 248/97 |
| 3,659,816 | A * | 5/1972 | Wilson | 248/97 |
| 3,861,125 | A * | 1/1975 | Hagemeister | 53/390 |
| 4,138,139 | A * | 2/1979 | Alfonso | 280/652 |
| 4,202,521 | A * | 5/1980 | Harding | 248/98 |
| 4,440,430 | A | 4/1984 | Kruse | |
| 4,445,658 | A * | 5/1984 | Ferron | 248/99 |
| D285,016 | S | 8/1986 | Claydon | |
| 4,708,307 | A | 11/1987 | Daigle | |
| 4,723,741 | A | 2/1988 | Doering | |
| 4,953,815 | A | 9/1990 | Beymer et al. | |
| 5,397,085 | A | 3/1995 | Spagnolo | |
| 5,765,789 | A | 6/1998 | Ryon et al. | |
| D418,653 | S | 1/2000 | Kent, Jr. | |
| 6,315,143 | B1 | 11/2001 | Dotts | |
| 2004/0195467 | A1 | 10/2004 | Passage | |

* cited by examiner

*Primary Examiner*—Korie Chan
(74) *Attorney, Agent, or Firm*—Kenneth H. Jack; Davis & Jack, L.L.C.

(57) ABSTRACT

A carrier for supporting a trash bag, the trash bag having an upper lip, the carrier having a frame having a forward end and a rearward end, the frame having an aperture extending therethrough; a handle fixedly attached to or formed wholly with the rearward end of the frame, the handle being positioned for, upon extension of the trash bag's upper lip through the aperture, single handed grasping of the handle and the upper lip; and a leg fixedly attached to or formed wholly with the forward end of the frame, the leg extending downwardly from the frame.

10 Claims, 2 Drawing Sheets

TRASH BAG CARRIER

FIELD OF THE INVENTION

This invention relates to trash bags and trash bag holders. More particularly, this invention relates to apparatus and assemblies adapted for holding and supporting trash bags.

BACKGROUND OF THE INVENTION

Highway maintenance workers commonly engage in roadside trash and litter collection. Such workers commonly carry with them a plastic trash bag for garbage collection, typically a thirty or thirty-three gallon bag. Typically, such worker grasps such bag with one hand at a point at or near the bag's upper lip, while the worker utilizes his or her other hand to retrieve articles of trash and litter from ground level. A problem associated with such trash bag usage arises when such worker attempts to insert a retrieved item of trash or litter into and through the upper opening of such bag. Such upper opening commonly hangs or droops vertically downwardly, either wholly or partially closing the bag and interfering with trash and litter insertion. Windy weather conditions may further undesirably interfere with manual insertion of items of trash and litter into such a plastic trash bag. When such trash bags become filled, they tend to rub or scrape against the ground or low brush, undesirably tearing the trash bag.

Trash bag holders are known, such holders performing functions of holding, supporting, and protecting a trash-bag and functioning to open a trash bag's upper lip. While such holders may effectively solve problems associated with single handed trash bag manipulation and use as described above, such holders are typically overly bulky and unwieldy, are mechanically complex, and are not economically fabricated and maintained.

The instant inventive trash bag carrier solves or ameliorates the above noted problems associated with manual single handed carriage of trash bags and associated with known trash bag stands and carriers by providing an apertured bag lip carrying frame which supports a handle adjacently associated with the aperture and which further supports a downwardly extending leg.

BRIEF SUMMARY OF THE INVENTION

A structural component of the instant inventive trash bag carrier comprises an upper frame having a forward end and a rearward end. Preferably, the rearward end of the upper frame has a trash bag lip receiving aperture extending therethrough. Such aperture is preferably circular having a preferred diameter of ¾" to 1". Such aperture size advantageously allows an upper lip of a plastic trash bag, upon being pulled therethrough, to compressively gather and frictionally hold the bag within the aperture. The upper frame preferably comprises a rearwardly opening "C" shaped bar, having left and right rearwardly extending arms, each having a distal end. Preferably the frame further comprises a flat plate which spans between and interconnects the left and right distal ends of the "C" bar. Where the preferred "C" bar and flat plate upper frame combination is provided, the bag lip receiving aperture preferably extends vertically through and is positioned upon the flat plate.

A further structural component of the instant inventive trash bag carrier comprises a handle which is fixedly attached to is or formed wholly with the rearward end of the frame. Preferably, the handle is further positioned so that an operator grasping the handle in one of his or her hands may simultaneously and single handedly grasp and hold a rearward portion of a trash bag lip which has been gathered and pulled downwardly through the aperture. Preferably, the handle comprises a forwardly opening "C" handle whose left and right arms are preferably situated respectively leftwardly and rightwardly from the aperture, such positioning causing the preferred "C" handle to span or arch over the aperture.

Preferably, the preferred rearwardly opening "C" bar in combination with the preferred forwardly opening "C" handle suggests or forms a continuous circular hoop, the preferred apertured plate constituting a cord which spans the rearward end of the interior of the hoop.

Suitably, the handle may alternately comprise a rearwardly extending cantilevered shaft whose proximal end is situated adjacent the bag lip receiving aperture for simultaneous single hand grasping as described above. Also suitably, the upper frame may be alternately configured as a square, rectangularly, as an oval, or other geometric shapes.

A final structural component of the instant inventive trash bag carrier preferably comprises a singular leg which is fixedly attached to or is formed wholly with the upper frame. Preferably, the leg extends downwardly from the forward end of the frame. The leg preferably comprises a "U" bar having a base, and having upwardly extending left and right arms, each of the upwardly extending left and right arms preferably having base and distal ends. Where the leg comprises the preferred "U" bar construction, such bar advantageously forms a trash bag catching grid. To form the desirable grid, the left and right arms of the "U" bar preferably cross and centrally intersect so that the upper or distal ends of the left and right arms respectively attach to the forward end of the upper frame rightwardly and leftwardly with respect to each other. Also, in further formation of the grid, the base of the "U" bar is preferably bent so that a central section of the base extends upwardly. Where the preferred "U" bar leg includes crossing arms as described above and incorporates an upwardly extending base section, the leg advantageously dually functions as a support member and as a trash bag catching grid. The catching grid function of such preferred leg prevents a trash bag attached to the upper frame from undesirably flapping in the wind. Upon filling of the trash bag, such leg configured as a trash bag catching grid also advantageously prevents filled trash bags from swinging downwardly and forwardly into contact with the ground.

In use of the instant inventive trash bag carrier, the base end of a trash bag may be extended downwardly into and through the opening of the carrier's upper frame until 3" to 4" inches of the upper end or upper lip of the trash bag remains above the frame. Thereafter, the forward end of the lip of the trash bag may be draped semi-circularly about the forward or "C" bar end of the frame. Thereafter, the rearward end of such bag lip is gathered, and is extended downwardly through the frame's bag lip receiving aperture, such extension forming a tail. Thereafter, the operator may forcefully pull downwardly and rearwardly upon the tail, causing the bag's lip to draw tight about the upper frame, securing the upper lip of the trash bag about the upper frame. Thereafter, the operator may carry the frame by holding its preferred "C" handle while simultaneously holding and securing the tail, continuing to secure the lip of the bag about the frame by holding the bag carrier and bag in such manner, an operator may conveniently carry the bag and trash bag carrier along a road or throughout a park. Upon coming to an article of trash to be retrieved from the ground, the operator may cause the trash bag carrier to rest the base end of its leg upon the ground while stooping to ground level to retrieve the article of trash. Thereafter, the article of trash may be inserted into the upper opening of the bag. Use of the trash bag carrier in such fashion advantageously protects the trash bag from snagging and tearing against the ground.

Accordingly, objects of the instant invention include the provision of an economically and mechanically simply fabricated trash bag carrier comprising an upper frame having a handle and bag lip receiving aperture which are adjacently positioned for facilitating single handed carriage of the trash bag carrier and simultaneous holding of a trash bag upon the trash bag carrier.

A further object of the instant invention is the provision of such trash bag carrier further incorporating a single leg configured for dually functioning as a trash bag protecting and catching grid and as a trash bag supporting member.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
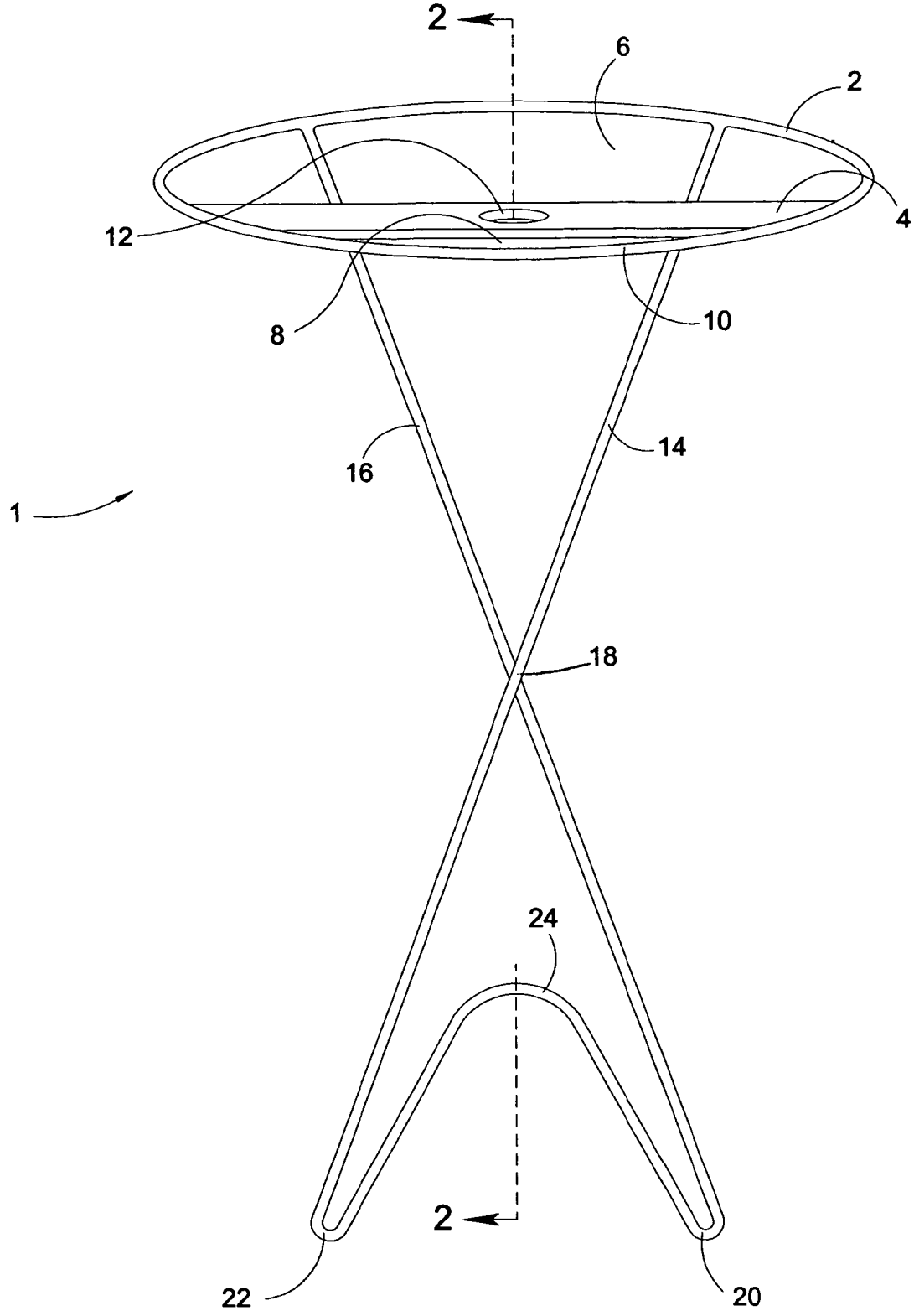
FIG. 1 is a perspective view of the instant inventive trash bag carrier.

Referring now to the drawings, and in particular to FIG. 1, the instant inventive trash bag carrier is referred to generally by Reference Arrow 1. The trash bag carrier 1 comprises an upper frame member, preferably including a rearwardly opening "C" bar 2, the "C" bar 2 having left and right arms, each having a rearward distal end. The upper frame preferably further comprises and is peripherally completed by a plate 4 which spans between and interconnects the left and right distal ends of the "C" bar 2. The "C" bar 2 in combination with plate 4 defines a bag receiving opening 6.

Referring further to FIG. 1, a forwardly opening "C" handle 10 is preferably fixedly attached to or is formed wholly with the rearward end of the upper frame member. Forwardly extending left and right arms of the "C" handle 10 are preferably positioned respectively leftwardly and rightwardly from a bag lip receiving aperture 12 which preferably extends vertically through plate 4. The "C" bar 2, the plate 4, and the "C" handle 10 are preferably composed of steel.

Referring further to FIG. 1, a single leg is fixedly attached to or is formed wholly with the forward end of "C" bar 2. The leg preferably comprises a steel "U" bar having left and right upwardly extending arms 14 and 16, and having a base 24. The upper or distal ends of arms 14 and 16 are preferably fixedly welded to the "C" bar 2 of the upper frame. Preferably, such arms angularly oriented from their base ends so that they intersect at point 18. Also preferably, the base 24 is bent and formed to include rearwardly curved foot sections 20 and 22, and to arcuately extend upwardly. The arms 14 and 16 in combination with intersection 18, and in combination with the upwardly and forwardly extending base 24 advantageously form and function as a trash bag supporting and protecting grid.

Figure 2:
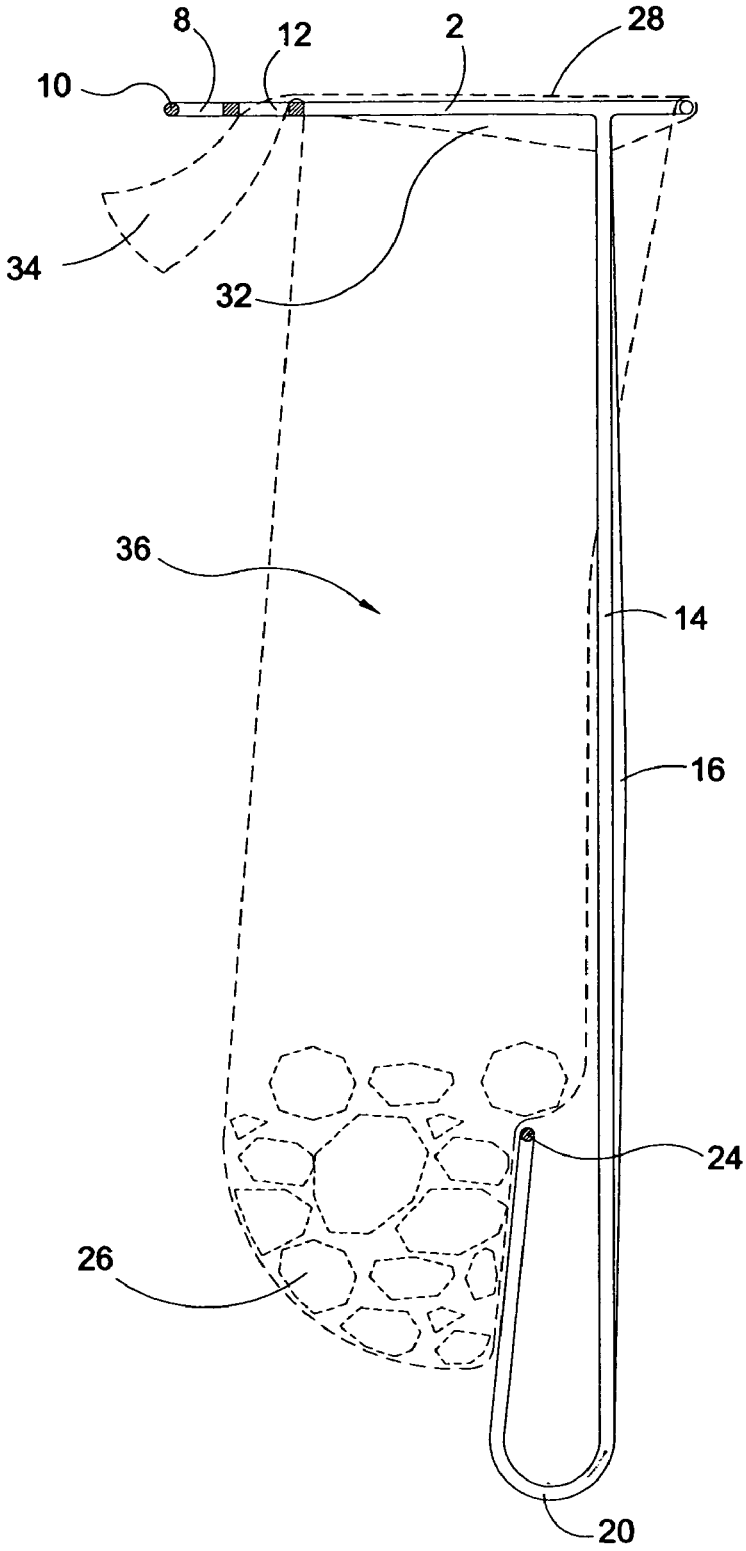
FIG. 2 is a sectional view of the carrier of FIG. 1, the view additionally showing in ghost a trash bag installed upon the carrier.

In use of the instant inventive trash bag carrier 1, referring simultaneously to FIGS. 1 and 2, a trash bag 36 may be extended downwardly through opening 6 of the upper frame. Thereafter, approximately 3" to 4" of the forward end of the upper lip 32 of trash bag 36 may be annularly draped about the forward end of the frame. Thereafter, the rearward end of the lip of the trash bag 36 may be gathered into a tail 34. Thereafter, the tail section 34 of the bag's lip 32 may be extended rearwardly and thence downwardly through aperture 12. Thereafter, an operator while single handedly grasping handle 10 with fingers extending through space 8 may utilize his or her other hand to pull downwardly and rearwardly upon tail 34 drawing the rearward end of upper lip 32 of bag 34 through aperture 12. Such rearward pulling force applied to tail 34 draws lip 32 about "C" bar 2, forming a tight and secure seal 28 thereabout. Preferably, the diameter of aperture 12 is ¾" to 1" so that, upon rearward and downward drawing of tail 34, the peripheral walls of aperture 12 may press inwardly upon tail 34 and assist in holding tail 34 in place.

In further operation of the inventive trash bag carrier 1, referring further simultaneously to FIGS. 1 and 2, such operator may conveniently grasp handle 10, while simultaneously holding and grasping, with the same hand, tail 34. The adjacent positioning of handle 10 and aperture 12 allows said single hand to conveniently carry the trash bag carrier 1, along with trash bag 36 while continuously securing the upper lip 32 of trash bag 36 about "C" bar 2, continuously maintaining the secure upper seal 28. While such secure seal 28 is maintained through simultaneous single handed grasping of handle 10 and tail 34, articles of trash 26 may be dropped downwardly through opening 6 and into the interior space of bag 36. Pulling pressure applied to tail 34 in combination with compression applied by aperture 12 to tail 34 effectively resists the tendency of trash 26 to disengage the upper lip 32 of bag 36 from "C" bar 2.

Referring further simultaneously to FIGS. 1 and 2, while trash fills the interior space of trash bag 36, the carrier's single leg configured to form a bag catching "X" grid advantageously prevents the trash bag 36 from swinging forwardly or undesirably oscillating or waving in the wind with respect to the upper frame.

Referring further simultaneously to FIGS. 1 and 2, while utilizing the instant inventive trash bag carrier 1, an operator may grasp handle 10 and tail 34 with a single hand, carrying the trash bag carrier to a location where an article of trash lies upon the ground. Thereafter, such operator may conveniently cause the carrier's leg to extend and move downwardly toward the ground, allowing the rearwardly curved bends or feet 20 and 22 to come to rest upon the ground. Thereafter, such operator may stoop to ground level to retrieve such article of trash, allowing the carrier to advantageously support the trash bag 36 in an upright position and protect the bag from abrasive contact with the ground.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A carrier for supporting a trash bag, the trash bag having an upper lip, the carrier comprising:

(a) a frame having a forward end and a rearward end, the rearward end of the frame having a plate spanning across and attached to the rearward end; the plate having an aperture extending therethrough, wherein an opening is defined between the frame and the plate for receiving the trash bag;

(b) a handle fixedly attached to or formed wholly with the rearward end of the frame, the handle being positioned for, upon extension of the trash bag's upper lip through the aperture, single handed grasping of the handle and the trash bag's upper lip; and (c) a leg fixedly attached to or formed wholly with the forward end of the frame, the leg extending downwardly from the frame, the handle being positioned oppositely from the forward end of the frame.

2. The carrier of claim 1 wherein the handle comprises a "C" handle.

3. The carrier of claim 2 wherein the "C" handle opens forwardly and has left and right arms, the left arm being positioned leftwardly from the aperture, and the right arm being positioned rightwardly from the aperture.

4. The carrier of claim 1 wherein the frame comprises a "C" bar.

5. The carrier of claim 4 wherein the "C" bar opens rearwardly and has left and right distal ends, the frame further comprising said plate spanning between the left and right distal ends.

6. The carrier of claim 1 wherein the leg comprises a "U" bar having a base and having upwardly extending left and right arms, each of the upwardly extending left and right arms having a base and a distal ends.

7. The carrier of claim 6 wherein the upwardly extending left and right arms cross so that their distal ends are respectively positioned rightwardly and leftwardly from each other.

8. The carrier of claim 7 wherein the "U" bar's base extends upwardly from the base ends of the upwardly extending left and right arms.

9. The carrier of claim 8 wherein the "U" bar's base further extends rearwardly from the base ends of the upwardly extending left and right arms.

10. The carrier of claim 1 wherein the leg comprises a bag catching grid.

* * * * *